US007562406B1

(12) United States Patent
Leach

(10) Patent No.: US 7,562,406 B1
(45) Date of Patent: Jul. 21, 2009

(54) RECONFIGURABLE SUPPORT PILLOW WITH TANDEM WELLS

(76) Inventor: Jamie S. Leach, P.O. Box 717, Ada, OK (US) 74821-0717

( * ) Notice: Subject to any disclaimer, the term of this patent is extended or adjusted under 35 U.S.C. 154(b) by 0 days.

(21) Appl. No.: 12/042,474

(22) Filed: Mar. 5, 2008

(51) Int. Cl.
*A47G 9/10* (2006.01)
*A47C 16/00* (2006.01)

(52) U.S. Cl. ..... 5/655; 5/632; 5/657

(58) Field of Classification Search ..... 5/655, 5/657, 652, 630, 632, 636, 640
See application file for complete search history.

(56) References Cited

U.S. PATENT DOCUMENTS

| | | | | |
|---|---|---|---|---|
| 2,953,793 | A | 9/1960 | Rossi | |
| 3,899,797 | A | 8/1975 | Gunst | |
| 4,731,890 | A * | 3/1988 | Roberts | 5/655 |
| 4,834,459 | A | 5/1989 | Leach | |
| 4,861,109 | A | 8/1989 | Leach | |
| D303,897 | S | 10/1989 | Phillips | |
| D309,018 | S | 7/1990 | Leach | |
| D318,969 | S | 8/1991 | Byrn | |
| 5,103,514 | A * | 4/1992 | Leach | 5/417 |
| 5,325,818 | A | 7/1994 | Leach | |
| 5,519,906 | A * | 5/1996 | Fanto-Chan | 5/631 |
| 5,581,833 | A * | 12/1996 | Zenoff | 5/655 |
| 6,279,185 | B1 * | 8/2001 | Matthews | 5/655 |
| 6,343,727 | B1 | 2/2002 | Leach | |
| 6,412,128 | B1 * | 7/2002 | Matthews | 5/655 |
| 6,427,251 | B1 | 8/2002 | Leach | |
| 6,484,337 | B1 * | 11/2002 | Moe et al. | 5/652 |
| 6,499,164 | B1 * | 12/2002 | Leach | 5/632 |
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,874,183 | B1 | 4/2005 | Taylor | |
| 7,010,821 | B1 * | 3/2006 | Leach | 5/655 |
| 7,114,206 | B2 * | 10/2006 | Leach | 5/632 |
| 7,353,552 | B2 * | 4/2008 | Leach | 5/632 |

(Continued)

OTHER PUBLICATIONS

The "All Nighter" product shown in the webpage from http://www.leachco.com published by Leachco, Inc. (Ada, OK, USA) on Oct. 11, 2007, was in public use and/or on sale at least since about May 2002.

(Continued)

*Primary Examiner*—Robert G Santos
(74) *Attorney, Agent, or Firm*—Mary M. Lee

(57) ABSTRACT

A reconfigurable support pillow with tandem wells, each sized for receiving an infant or toddler. The pillow comprises a center section and two curved arms. Each arm is generally C-shaped having a first end continuous with one end of the center section, a free end, and an elbow section therebetween. In its resting position, the pillow is characterized by two separate but adjacent wells. A first connector is attached to outer aspect of the elbow section of one arm, and a second connector is attached to the outer aspect of the elbow of the second arm. The pillow can be twisted into a spiral configuration or, alternately, can be folded into a two-tiered C-shaped configuration. The pillow is held in the desired configuration by attaching the connectors to each other. The pillow can also serve as a combination nursing pillow and therapeutic seat cushion.

8 Claims, 7 Drawing Sheets

U.S. PATENT DOCUMENTS

| | | | | |
|---|---|---|---|---|
| 7,404,222 | B2 * | 7/2008 | Tidwell | 5/655 |
| 7,500,278 | B2 | 3/2009 | Leach | |
| 7,513,001 | B1 | 4/2009 | Leach | |
| 7,540,049 | * | 6/2009 | Sklenarik et al. | 5/630 |
| 2002/0029422 | A1 * | 3/2002 | Matthews | 5/655 |
| 2005/0278864 | A1 * | 12/2005 | Leach | 5/732 |
| 2006/0031992 | A1 | 2/2006 | Moore | |
| 2007/0022526 | A1 | 2/2007 | Leach | |
| 2007/0028384 | A1 * | 2/2007 | Leach | 5/632 |
| 2007/0046084 | A1 | 3/2007 | Leach | |
| 2007/0151031 | A1 * | 7/2007 | Leach | 5/632 |
| 2007/0277321 | A1 | 12/2007 | Leach | |
| 2009/0007335 | A1 * | 1/2009 | Tidwell | 5/652 |
| 2009/0094752 | A1 * | 4/2009 | Gagliano et al. | 5/655 |
| 2009/0133193 | A1 * | 5/2009 | Weise | 5/640 |

OTHER PUBLICATIONS

The "Preggle" product shown in the webpage from http://www.leachco.com published by Leachco, Inc. (Ada, OK, USA) on Jul. 29, 2009, was in public use and/or on sale at least since about Dec. 2006.

The "Snoogle Loop" product shown in the webpage from http://www.leachco.com published by Leachco, Inc. (Ada, OK, USA) on Jun. 19, 2008, was in public use and/or on sale at least since about Dec. 1999.

The "Snoogle" product shown in the webpage from http://www.leachco.com published by Leachco, Inc. (Ada, OK, USA) on Oct. 8, 2007, was in public use and/or on sale at least since about May 1999.

The "Cuddle-U" product shown in the webpage from http://www.leachco.com published by Leachco, Inc. (Ada, OK, USA) on Jul. 29, 2008, was in public use and/or on sale at least since prior about May 2003.

The "Back 'N Belly" product shown in the webpage from http://www.leachco.com published by Leachco, Inc. (Ada, OK, USA) on Oct. 11, 2007, was in public use and/or on sale at least since about Jun. 2003.

The "Two-By-You" product shown in the webpage from http://www.leachco.com published by Leachco, Inc. (Ada, OK, USA) on Jun. 19, 2008, was in public use and/or on sale at least since about about Oct. 2005.

The "Lil' Snoogle" product shown in the webpage from http://www.leachco.com published by Leachco, Inc. (Ada, OK, USA) on Oct. 11, 2007, was in public use and/or on sale at least since about Dec. 1999.

The "Snoogle MIni" product shown in the webpage from http://www.leachco.com published by Leachco, Inc. (Ada, OK, USA) on Oct. 11, 2007, was in public use and/or on sale at least since about Dec. 1999.

The "Snoogle Half-TIme" product shown in the webpage from http://www.leachco.com published by Leachco, Inc. (Ada, OK, USA) on Oct. 11, 2007, was in public use and/or on sale at least since about Jul. 2005.

The Grow To Sleep product shown in the webpage from http://www.leachco.com published by Leachco, Inc. (Ada, OK, USA) on Jun. 18, 2008, was in public and/or on sale at least since about Aug. 2005.

The "SnooZoo" product shown in the webpage from http://www.leachco.com published by Leachco, Inc. (Ada, OK, USA) on Oct. 11, 2007, was in public use and/or on sale at least since about May 2005.

The "Hooked On Comfort" product shown in the webpage from http://www.babyage.com published by BabyAge, Inc. (Wilkes Barre, PA) on Oct. 26, 2006, was in public use and/or on sale at least since prior to the filing date of this application, that is, prior to Mar. 5, 2008.

* cited by examiner

RECONFIGURABLE SUPPORT PILLOW WITH TANDEM WELLS

FIELD OF THE INVENTION

The present invention relates generally to support pillows and more particularly, but without limitation, to support pillows for infants and toddlers.

BACKGROUND OF THE INVENTION

Infant support pillow have become a staple of the modern nursery. They are lightweight, washable and serve many functions. Conventional C-shaped pillows allow an infant to be supported on its back in a reclining position or on its tummy for play time. These pillows also serve as nursing pillows, providing support for the nursing infant when the pillow encircles the mother's torso. There remains a need, however, for infant support pillows with more versatility. Specifically, there is a need for a support pillow that will accommodate two infants or toddlers, each in its own separate well, while also allowing multiple, alternate configurations.

DETAILED DESCRIPTION OF THE PREFERRED EMBODIMENTS

Figure 1:
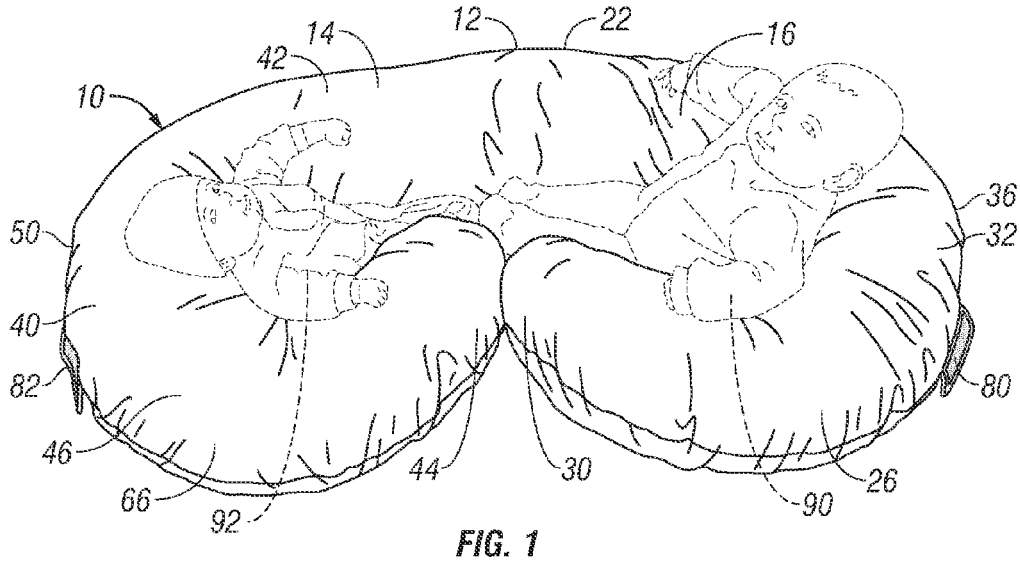
FIG. 1 is a frontal perspective view of a support pillow made with tandem wells in accordance with the present invention. The pillow is shown in its resting position. An infant, shown in broken lines, is positioned in one well, and a toddler, also shown in broken lines, is shown in the other well.

The present invention provides a support pillow especially suited for use with two babies. The two-lobed configuration of the pillow can support two babies separate from but adjacent to one another, each secure in its own well. Additionally, this pillow has alternate configurations. The pillow can be folded on itself to form a two-tiered C-shaped pillow or twisted into a spiral configuration. Each of these alternate configurations provides a support pillow with greater depth, making an ideal support pillow for larger babies and toddlers and having applications for adults as well.

Turning now to the drawings in general and to FIGS. 1-5 in particular, there is shown therein a support pillow made in accordance with a preferred embodiment of the present invention and designated generally by the reference numeral 10. The pillow 10 comprises a straight, elongate center section 12 having a first end 14 and a second end 16. The center section 12 has an inner perimeter 20 and an outer perimeter 22, as viewed in FIG. 2.

The pillow 10 further comprises a first arm 26 having a first end 28 continuous with the first end 14 of the center section 12. The first arm 26 terminates in a free end 30 and includes an elbow section 32 extending between the free end and the first end 28. The first arm 26 has an inner perimeter 34 and an outer perimeter 36. Still further, the pillow 10 comprises a second arm 40 similar to the first arm 26. The second arm 40 has a first end 42 continuous with the second end 16 of the center section 12. The second arm 40 terminates in a free end 44 and includes an elbow section 46 extending between the free end and the first end 42. The second arm 40 has an inner perimeter 48 and an outer perimeter 50.

The center section 12 and the first and second arms 26 and 40 all are formed of compressible resilient material so that the pillow 10 provides good cushioning and returns to its original shape or resting position after being deformed. As used herein, "resting position" refers to the position and shape the pillow 10 naturally assumes when no tension or pressure is exerted on any part it.

Figure 3:
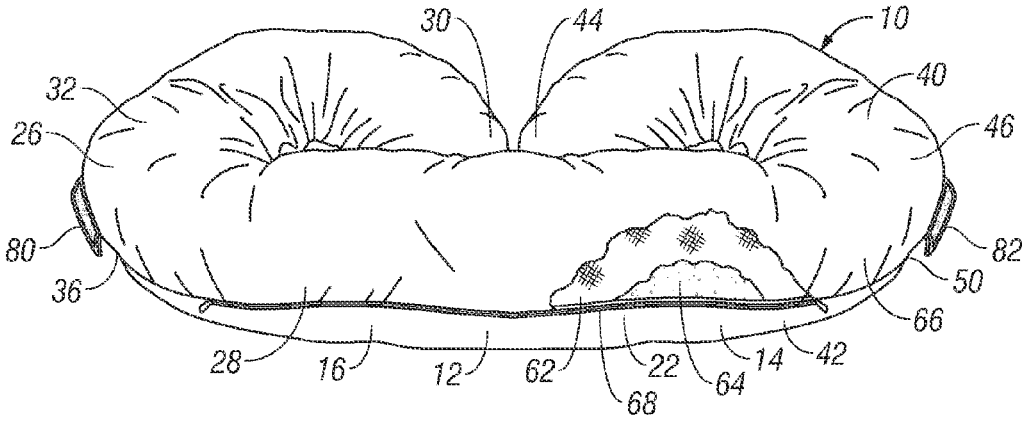
FIG. 3 is a rear perspective view of the pillow shown in FIG. 2.

As best seen in FIG. 3, the pillow preferably 10 preferably comprises a body 60 comprising a fabric enclosure 62 filled with a compressible, resilient material 64. The fabric enclosure 62 material may be any suitable fabric, including but not limited to waterproof nylon, flannel, or elastic fabrics, such as spandex or cotton-spandex blends. However, presently a polyester/cotton blend is preferred. The compressible, resilient material 64 may be solid or loose. For example, a preferred loose filler is polyester fiberfill. Other suitable fillers include down feathers, memory foam, polystyrene pellets. In some instances, the body 60 of the pillow 10 may be an inflatable inner liner. This construction provides a continuous compressible and resilient pillow form.

In this embodiment, the body 60 is received in a removable, fabric cover 66. The cover 66 is formed similar to the enclosure 62, but may be designed for easy removal and cleaning. For example, the cover 66 may be provided with a zipper 68 along the outer perimeter 22 of the center section 12. Alternately, the closure for the fabric cover 66 may include but is not limited to buttons, snaps, ties, hook and loop connectors, or simply overlapping edges (not shown). Although the fabric of which the cover 66 is made may vary widely, a soft cotton fabric is highly preferred in most instances.

Now it will be apparent that the center section 12 and the first and second arms 26 and 40 of the pillow 10 may be continuous or integrally formed, and this is the preferred structure. In this embodiment, there is no precise dividing line between the center section 12 and the first and second arms 26 and 40, that is, it is not critical where one ends and the other begins.

In the preferred embodiment, the pillow 10 is shaped so that in its resting position, illustrated in FIGS. 1-4, the first and second arms 26 and 40 are generally C shaped and form two lobes, preferably of about equal size and also preferably having the same shape. The inner perimeter 34 of the first arm 26 and the inner perimeter 48 of the second arm 40 each form a well 70 and 72, respectively, sized to receive an infant or toddler. Though the size or diameter of the wells 70 and 72 may vary, a well having a diameter of about 4 to about 8 inches is ideal. As used herein, "infant" refers generally to smaller, younger babies, including newborns, while "toddler" refers generally to larger, older babies, the distinction being merely one of size.

It will also be apparent now that the well 70 of the first arm 26 is separate and spaced a distance apart from the well 72 of the second arm 40. The first arm 26 curves inwardly so that the free end 28 approaches the inner perimeter 20 of the center section 12 forming a small frontal opening 74 to the well 70. Likewise, the second arm 40 curves inwardly, forming a shape that mirrors the shape of the first arm 26. Thus, the free end 44 approaches the inner perimeter 20 of the center section 12 forming a small frontal opening 76 to the well 72. The frontal openings 74 and 76 generally oppose each other.

Figure 2:
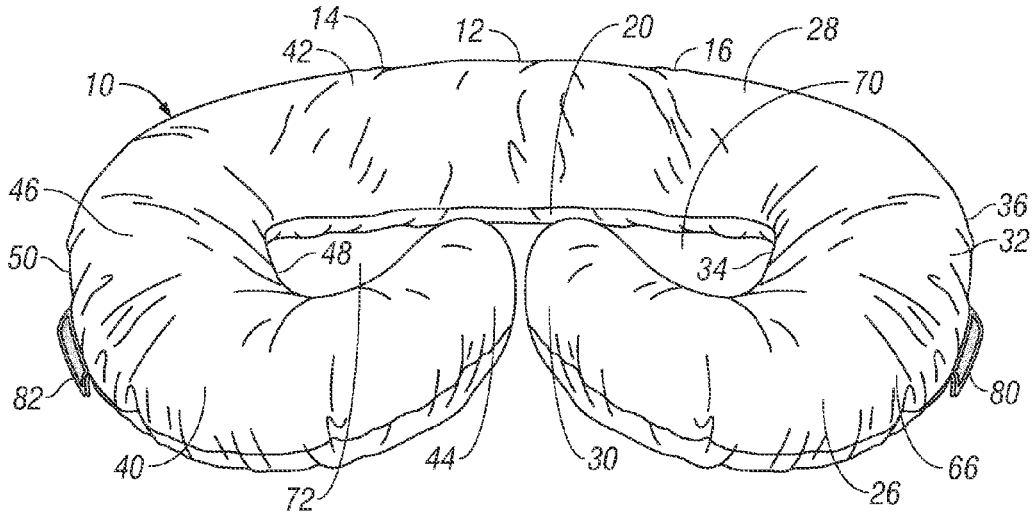
FIG. 2 is a frontal perspective view of the pillow shown in FIG. 1, without the infant and toddler.
Figure 4:
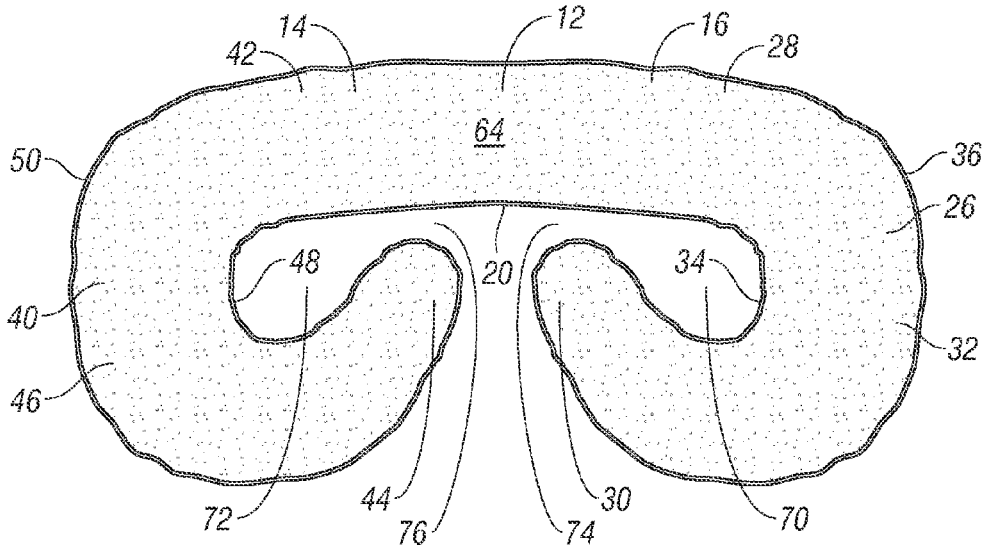
FIG. 4 is a longitudinal sectional view of the pillow in FIG. 2. The free ends 30 and 44 of the arms 26 and 40 have been pulled away from the center section 12 for illustrative purposes.

In the pillow's resting position, the free ends 28 and 44 preferably touch the inner perimeter 20 of the center section 12, as shown in FIG. 2, but alternately they may be spaced a small distance from the center section as shown in FIG. 4. However, in any case, each of the arms 26 and 40 preferably is curved inwardly far enough that the free ends 28 and 44 either touch the center section 12 or are spaced therefrom a distance less than the width of the wells 70 and 72.

Although the wells 70 and 72 preferably are tear drop shaped, they may be virtually any shape, such as circular, oval, square or some other polygonal shape. The outer perimeters 36 and 50 of the arms 26 and 40 may also take different shapes. For example, although generally circular is preferred, alternately they may be angular, such as square or polygonal. Additionally, the perimeters 36 and 50 of the arms 26 and 40 and the outer perimeter 22 of the center section 12 may be decoratively formed, such as scalloped, without affecting the intended function of the pillow 10.

Figure 5:
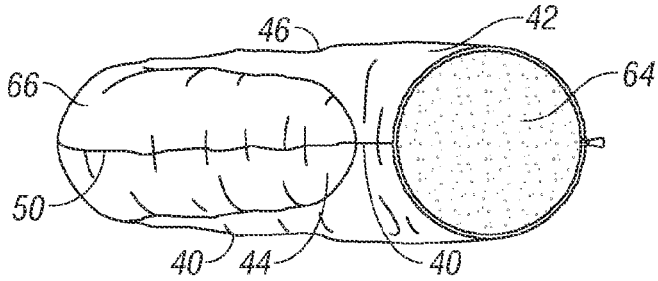
FIG. 5 is a transverse sectional view of the pillow in FIG. 2.

The ideal cross-sectional shape for the pillow 10, as best seen in FIG. 5, is generally cylindrical, that is, generally circular in cross-section. The width or diameter of the center section 12 and the arms 26 and 40 usually will be in the range of about 4 to about 10 inches, tapering slightly at the free ends 28 and 42. The outer diameter of each lobe or curved arm 26 and 40 may be about 20 to about 40 inches. The overall length of the pillow 10 may vary as well, but a preferred length is between about 3 feet and about 5 feet.

Figure 6:
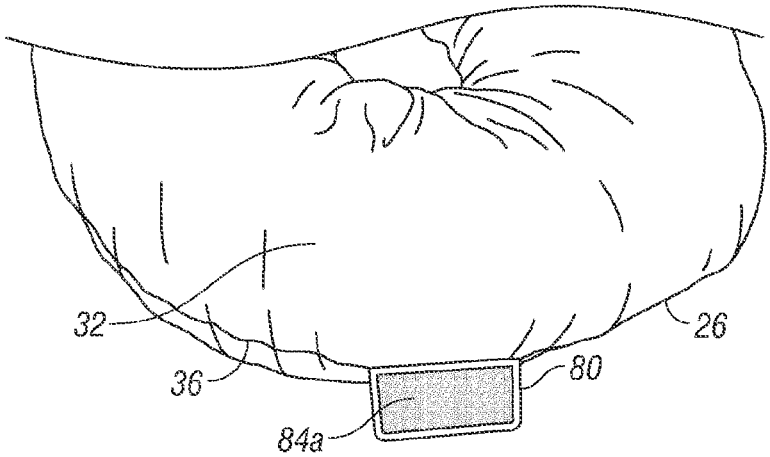
FIG. 6 is a fragmented, perspective view of a first end of the pillow in FIG. 2.
Figure 7:
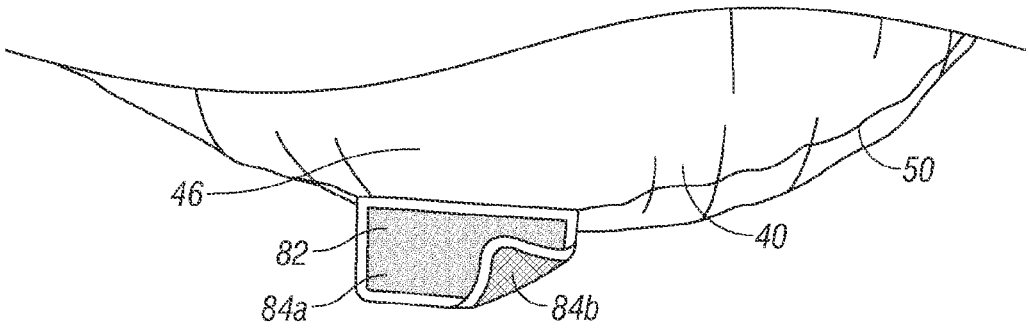
FIG. 7 is a fragmented, perspective view of a second end of the pillow in FIG. 2.

With continuing reference to FIGS. 1-5 and turning now also to FIGS. 6 and 7, the pillow 10 further comprises a first connector 80 on the outer perimeter 36 of the first arm 26 and a second connector 82 on the outer perimeter 50 of the second arm 40. The first and second connectors 80 and 82 are connectable to each other so that the pillow 10 can be reconfigured (described below) and secured in the reconfigured shape.

Most preferably, each of the first and second connectors 80 and 82 takes the form of a flap to which hook-and-loop fastener material 84*a* and 84*b* is affixed. In the embodiment shown and described herein, the connector flap 80 on the first arm has the "soft" hook-and-loop fastener material 84*a* on both sides, while the connector flap 82 has the "hard" hook-and-loop fastener material 84*b* on the underside and plan fabric on the other side 86. Of course, virtually any other type of connector may be substituted for the hook-and-loop fasteners, including but not limited to buttons, snaps, ties, and hooks. Though the precise location of the connectors 80 and 82 may vary, a preferred location is centered on the outer perimeter of the elbow sections 32 and 46, respectively, of the first and second arms 26 and 40.

Having described a preferred structure for the pillow 10 of the present invention, its use now will be explained. One use for the pillow 10 in its resting position is shown in FIG. 1. In this configuration, the two arms 26 and 40 form tandem infant support pillows joined by the common center section 12. A larger baby or toddler 90 is positioned in the first arm 26, and a smaller infant 92 is shown in the second arm 40. As shown, the babies 90 ad 92 are placed feet-to-feet, facing each other, with the arms 26 and 40 encircling their torsos. Alternately, the babies 90 and 92 could be placed in a side-by-side arrangement, reclining across the open wells, 70 and 72, respectively. Still further, the babies 90 and 92 may be positioned on their tummies for play time.

Figure 8:
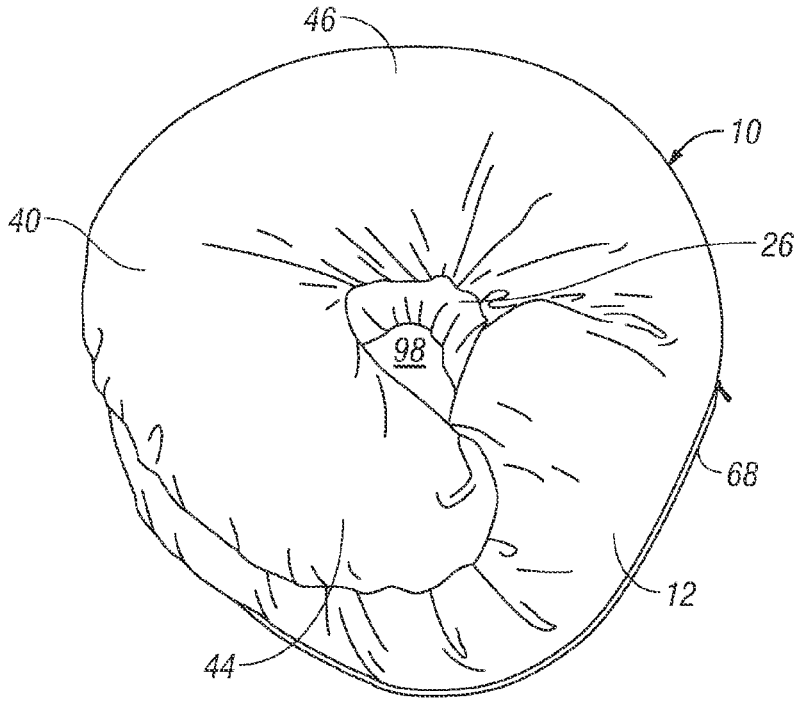
FIG. 8 is a frontal perspective view of the pillow twisted into a spiral configuration.
Figure 9:
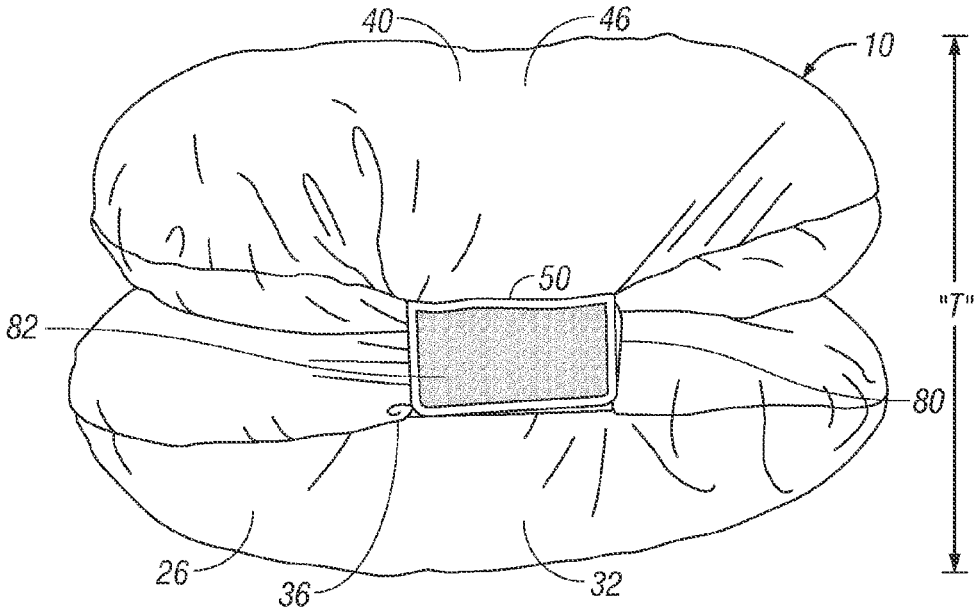
FIG. 9 is a rear perspective view of the pillow twisted into a spiral configuration.
Figure 10:
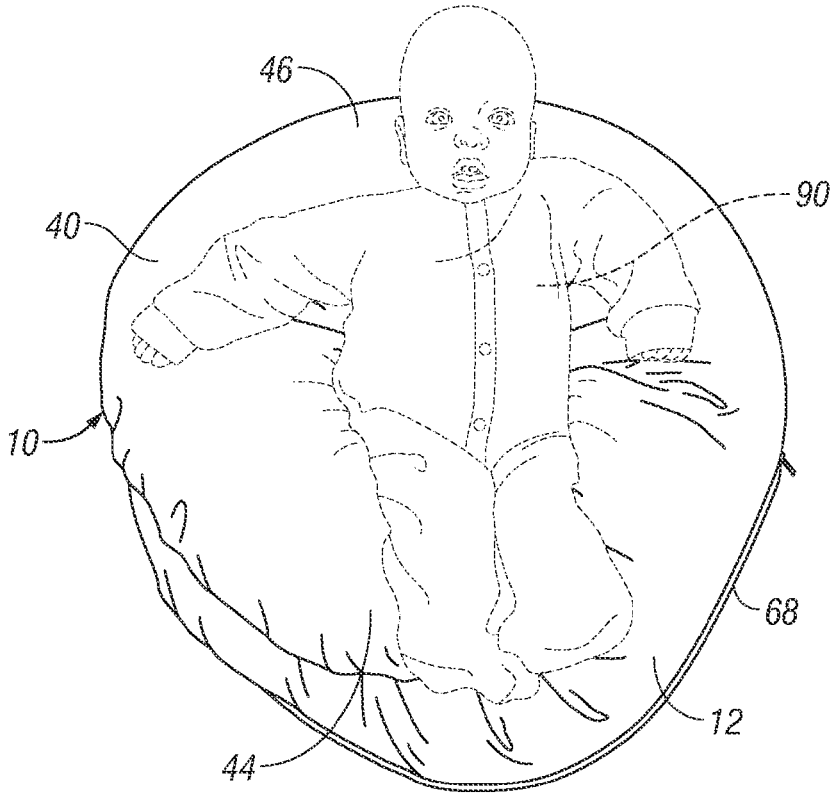
FIG. 10 a frontal perspective view of the pillow in the spiral position shown in FIG. 8 with a baby, shown in broken lines, reclining in the well of the upper arm.

With reference now to FIGS. 8-10, an alternate configuration for the pillow 10 is shown and described. In this configuration, the first and second arms 26 and 40 are twisted around, one on top of the other, to form a spiral configuration. In this position, the connectors 80 and 82 are immediately adjacent each other, so that the side 84*a* of one flap (connector) 80 engages the side 84*b* of the other flap (connector) 82, as best seen in FIG. 7. With the connectors 80 and 82 attached to each other in this manner, the pillow 10 is secured in the spiral configuration.

In this spiral configuration, the thickness "T" of the pillow 10 (FIG. 9) is twice that of the pillow in the resting position, and thus the enclosed center well 98 is twice as deep as the wells 70 and 72. As shown in FIG. 10, a toddler 90 may be placed across the center well 98 in a reclining position. Alternately, the toddler 90 may be placed standing inside the center well 98, or in a number of other positions.

Figure 11:
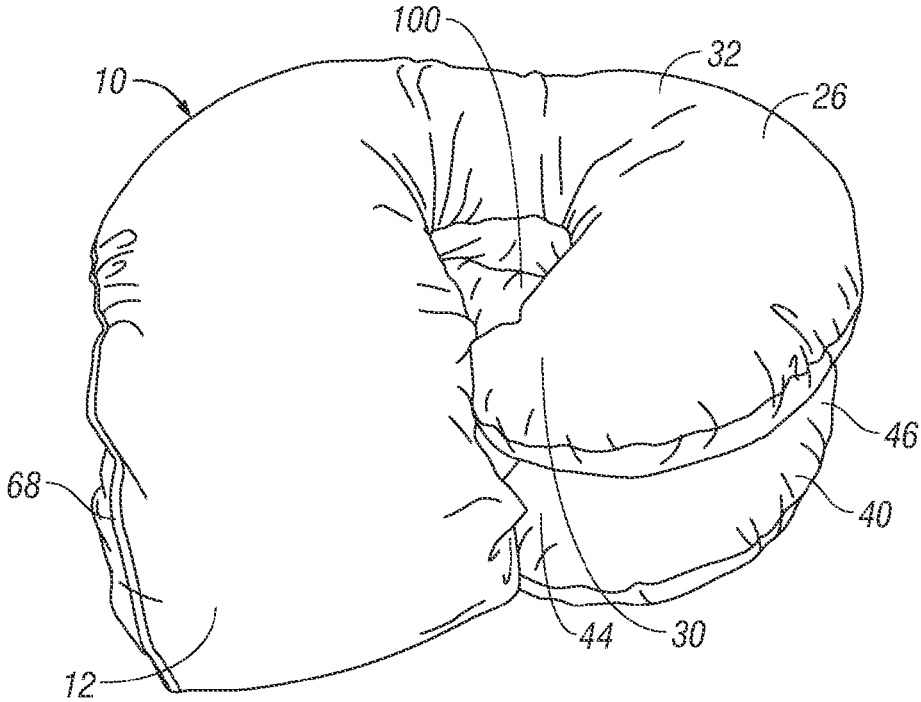
FIG. 11 is a frontal perspective view of the pillow folded into a double-layer C-shaped configuration.
Figure 12:
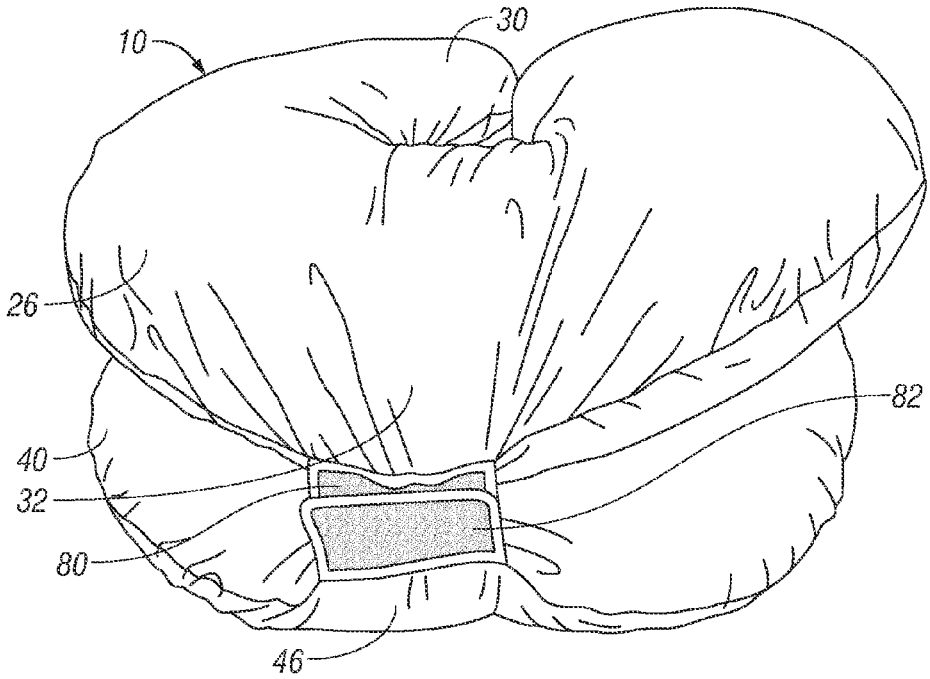
FIG. 12 is a rear perspective view of the folded pillow shown in FIG. 11.
Figure 13:
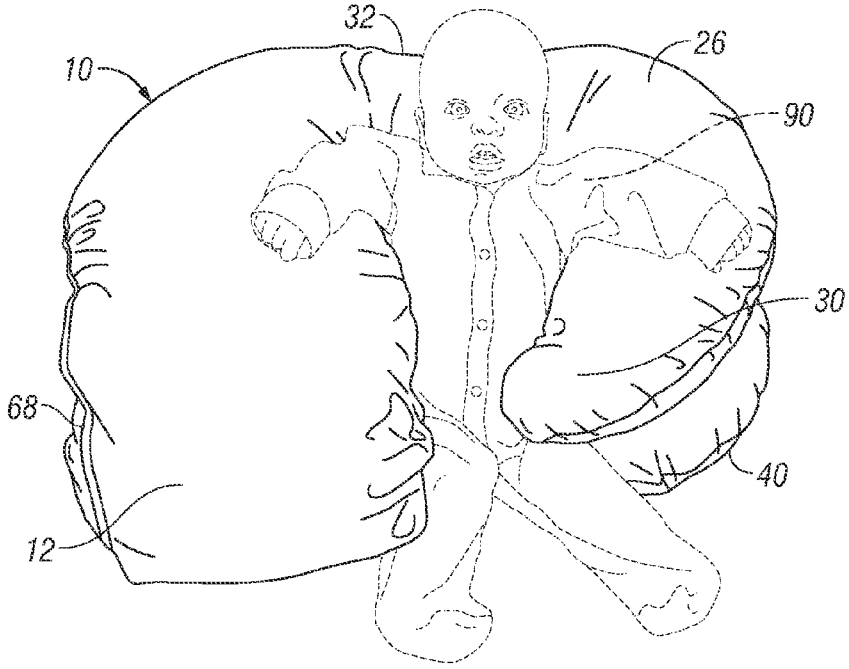
FIG. 13 is a frontal perspective view of the folded pillow of FIG. 11 with a baby, shown in broken lines, seated inside the C-shaped well.

Turning now to FIGS. 11-13, the folded configuration of the pillow 10 will be explained. To achieve this configuration, the pillow 10 is simply folded in half, so that the first arm 26 overlies the second arm 40 (or vice versa). In this configuration the center well 100 is open in the front (FIG. 11), rather than completely enclosed or encircled by the arms 26 and 40, as in the spiral configuration of FIGS. 8-10. This is ideal for the larger baby, such as the toddler 90, as shown in FIG. 13, who is tall enough to sit up inside the well 100. Though, as in the other configurations, babies 90 or 92 may be arranged in a variety of positions.

Figure 14:
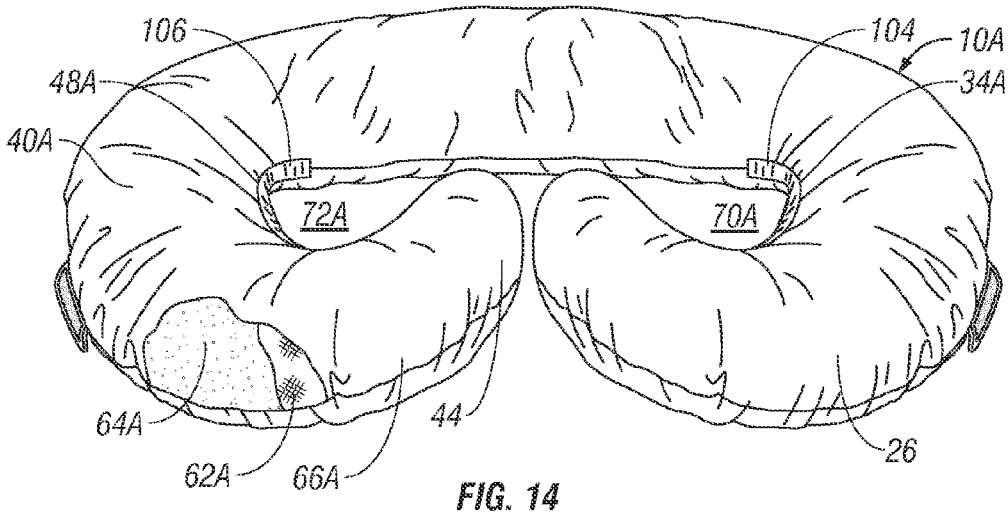
FIG. 14 is a frontal perspective view of a second embodiment of the pillow of the present invention in which the inner perimeter of the wells comprises an elastic strip.
Figure 15:
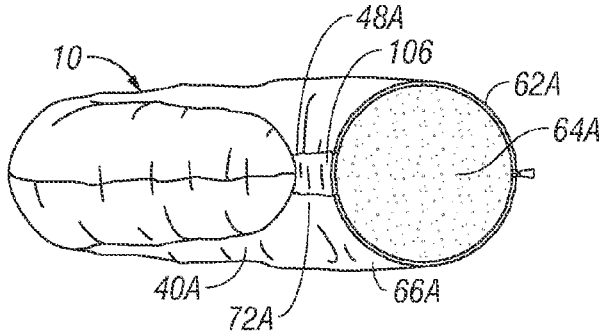
FIG. 15 is a transverse sectional view of the pillow in FIG. 14.

Shown in FIGS. 14 and 15 is a second embodiment of the present invention. In this embodiment, designated as 10A, the inner perimeters 34A and 48A of the first and second arms 26A and 40A, forming the wells 70A and 72A, each comprises an elastic panel of strip 104 and 106 at least partially around the wells. This elastic strip may be formed in several ways. For example, a separate panel of the material from which the removable cover 66A is made may be sewn into the inner seam of the cover. Alternately, a band of elastic may be either sewn inside the inner perimeter of the enclosure 62A or the removable cover 66A, or substituted for a strip of the fabric of the either the enclosure or the cover.

Most preferably, the elastic strips 104 and 106 will be inserted so that when the pillow 10A is in a resting position, the elastic strips are at least slightly tensioned. In this way, the arms 26A and 40A will gently hug or embrace the infant's body even when the pillow 10A is in the resting position and will also resist spreading of the arms 26A and 40A when an infant is placed in the wells 70A and 72A of the pillow.

Now it will be appreciated that the pillow 10 and 10A of the present invention has many desirable features and advantages. It is ideal for use with twins or two babies of any size or age, but has uses for adults as well. For example, when the pillow is twisted into the spiral configuration, it may be used as a combination seat and nursing pillow; the mother sits on the bottom arm and rests the top arm on her lap to support the nursing infant. The generally toroidal shape of the curved arms is ideal for the relief of discomfort from hemorrhoids or a recent episiotomy. Or, in yet another application, the mother can lift up the top arm of the pillow so that it is perpendicular to the bottom arm on the seat, whereupon the top arm serves as a back pillow. These and other uses and configurations will be readily apparent from the unique structure of this inventive pillow.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A support pillow comprising:

an elongate center section having a first end and a second end and having an inner perimeter and an outer perimeter;

a first arm comprising a first end continuous with the first end of the center section, a free end, and an elbow section therebetween, the first arm having an inner perimeter and an outer perimeter;

a second arm comprising a first end continuous with the second end of the center section, a free end, and an elbow section therebetween, the second arm having an inner perimeter and an outer perimeter;

wherein the pillow is comprised of compressible, resilient material;

wherein, when the pillow is in its resting position, the first and second arms both are generally C-shaped forming two lobes, the inner perimeter of each arm forming a well sized to receive an infant or toddler, the well of the first arm being separate and spaced apart from the well of the second arm, the free end of each arm forming with the adjacent portion of the center section a frontal opening to the well, the frontal openings formed by the first and second arms generally opposing each other;

a first connector on the outer perimeter of the elbow section of the first arm; and a second connector on the outer perimeter of the elbow section of the second arm, the first and second connectors being connectable to each other so that the pillow alternately can be twisted and secured into a two-tiered spiral configuration or folded and secured into a two-tiered C-shaped configuration.

2. The support pillow of claim 1 wherein the lobes formed by the first and second arms are about the same size.

3. The support pillow of claim 1 wherein the wells are generally tear-drop shaped.

4. The support pillow of claim 1 wherein the connectors comprise hook-and-loop type fasteners.

5. The support pillow of claim 1 wherein the center section and first and second arms are formed of a continuous length of compressible, resilient material.

6. The support pillow of claim 1 wherein the pillow comprises a body comprising a fabric enclosure filled with compressible, resilient material.

7. The support pillow of claim 6 wherein the pillow further comprises a removable fabric cover sized to receive the body.

8. The support pillow of claim 1 wherein the inner perimeter of the first and second arms each comprises an elastic strip that extends at least partially around the well.

* * * * *